US008096291B2

(12) United States Patent
Chen

(10) Patent No.: US 8,096,291 B2
(45) Date of Patent: Jan. 17, 2012

(54) SUPERCHARGED TUBE OF A VEHICLE AIR INTAKE STRUCTURE

(76) Inventor: Shu-Kuo Chen, Tainan (TW)

( * ) Notice: Subject to any disclaimer, the term of this patent is extended or adjusted under 35 U.S.C. 154(b) by 356 days.

(21) Appl. No.: 12/355,835

(22) Filed: Jan. 19, 2009

(65) Prior Publication Data

US 2009/0120398 A1 May 14, 2009

Related U.S. Application Data

(63) Continuation-in-part of application No. 11/554,841, filed on Oct. 31, 2006, now abandoned.

(51) Int. Cl.

| | |
|---|---|
| ***F02B 23/00*** | (2006.01) |
| ***F02B 77/04*** | (2006.01) |
| ***F02M 25/00*** | (2006.01) |
| ***F02M 35/02*** | (2006.01) |

(52) U.S. Cl. ..... 123/585; 123/198 E

(58) Field of Classification Search ..... 123/585, 123/480, 198 A, 566

See application file for complete search history.

(56) References Cited

U.S. PATENT DOCUMENTS

| | | | | |
|---|---|---|---|---|
| 2,297,817 | A * | 10/1942 | Truxell, Jr et al. | 210/496 |
| 4,030,456 | A | 6/1977 | Corpus | 123/25 B |
| 4,649,885 | A | 3/1987 | Salzer | 123/25 B |
| 5,894,088 | A * | 4/1999 | Sawada et al. | 73/204.19 |
| 7,013,846 | B2 | 3/2006 | Hagglund et al. | 123/406.46 |
| 2005/0022484 | A1 * | 2/2005 | Krisko et al. | 55/337 |
| 2007/0235012 | A1 | 10/2007 | Lam | 123/633 |

FOREIGN PATENT DOCUMENTS

| | | |
|---|---|---|
| JP | 05194055 A | 8/1993 |

* cited by examiner

*Primary Examiner* — Stephen K Cronin
*Assistant Examiner* — Sherman Manley
(74) *Attorney, Agent, or Firm* — Alan Kamrath; Kamrath IP Lawfirm, PA

(57) ABSTRACT

A supercharged tube of the vehicle air intake structure includes a body including first and second channels radially provided on two side walls thereof respectively. The first and second channels communicate with each other, with the first and second channels serving to communicate with an air pipe system of a brake booster and an intake manifold individually. The body is axially provided with a third channel communicating with an exterior. The third channel receives a tubular member with two ends, with one end including a first filter and another end including a second filter. The first and second filters include first and second mesh layers formed on outer end surfaces thereof individually. The first and second mesh layers are axially mounted in plural first and second passages individually, with inner diameters of the first and second passages being gradually reduced from outside to inside of the first and second mesh layers.

13 Claims, 6 Drawing Sheets

SUPERCHARGED TUBE OF A VEHICLE AIR INTAKE STRUCTURE

CROSS REFERENCE TO RELATED APPLICATION

This is a Continuation-in-Part application of U.S. patent application Ser. No. 11/554,841 filed Oct. 31, 2006, now abandoned.

BACKGROUND OF THE INVENTION

1. Field of the Invention

The present invention relates to a supercharged tube of a vehicle air intake structure and, more particularly, to a supercharged tube of a vehicle air intake structure which can introduce air to enhance pressure during engine burning processes.

2. Description of the Prior Art

A conventional intake manifold system always generates insufficient air propelling, and incomplete burning causes high oil consumption and air pollution. Besides, the insufficient air propelling will let a brake booster absorb inadequate air.

TW Pub. No. 553313 discloses an air intake structure for vehicles including a brake booster and an air collection box between which a boost cylinder is defined to introduce air into a filtering layer to be filtered during starting an engine. In order, air flows from an inlet of an air intake pipe to the air collection box through an air stone and a connection tube. However, carbon deposit will happen because of incomplete air burning to make a throttle get stuck, thus loosening a gas pedal. Thereafter, the throttle can not be completely closed to have an idle speed.

The present invention has arisen to mitigate and/or obviate the afore-described disadvantages.

SUMMARY OF THE INVENTION

The primary object of the present invention is to provide a supercharged tube of a vehicle air intake structure which can generate a double check-valve effect so that exterior air and hot air remaining inside flow slowly for a period of time. Hence, the exterior air (to support combustion), temperature (an ignition point), and combustible carbon deposit can be mixed and have a slowly-burning time, lowering carbon deposit.

To obtain the above objective, a supercharged tube of a vehicle air intake structure provided by the present invention comprises a body including a first channel and a second channel radially provided on two side walls thereof respectively. The first and second channels are in communication with each other. The channel can be used to communicate with an air pipe system of a brake booster, and the second channel is in communication with an intake manifold. The body is axially provided with a third channel which communicates with an exterior. The third channel receives a tubular member with two ends, with one end including a first filter and another end including a second filter. The first filter includes a first mesh layer formed on an outer end surface thereof, and the second filter includes a second mesh layer formed on an outer end surface thereof. The first and second mesh layers are axially mounted in a plurality of first and second passages individually, and inner diameters of the first and second passages are gradually reduced from outside to inside of the first and second mesh layers.

DETAILED DESCRIPTION OF THE PREFERRED EMBODIMENTS

Figure 1:
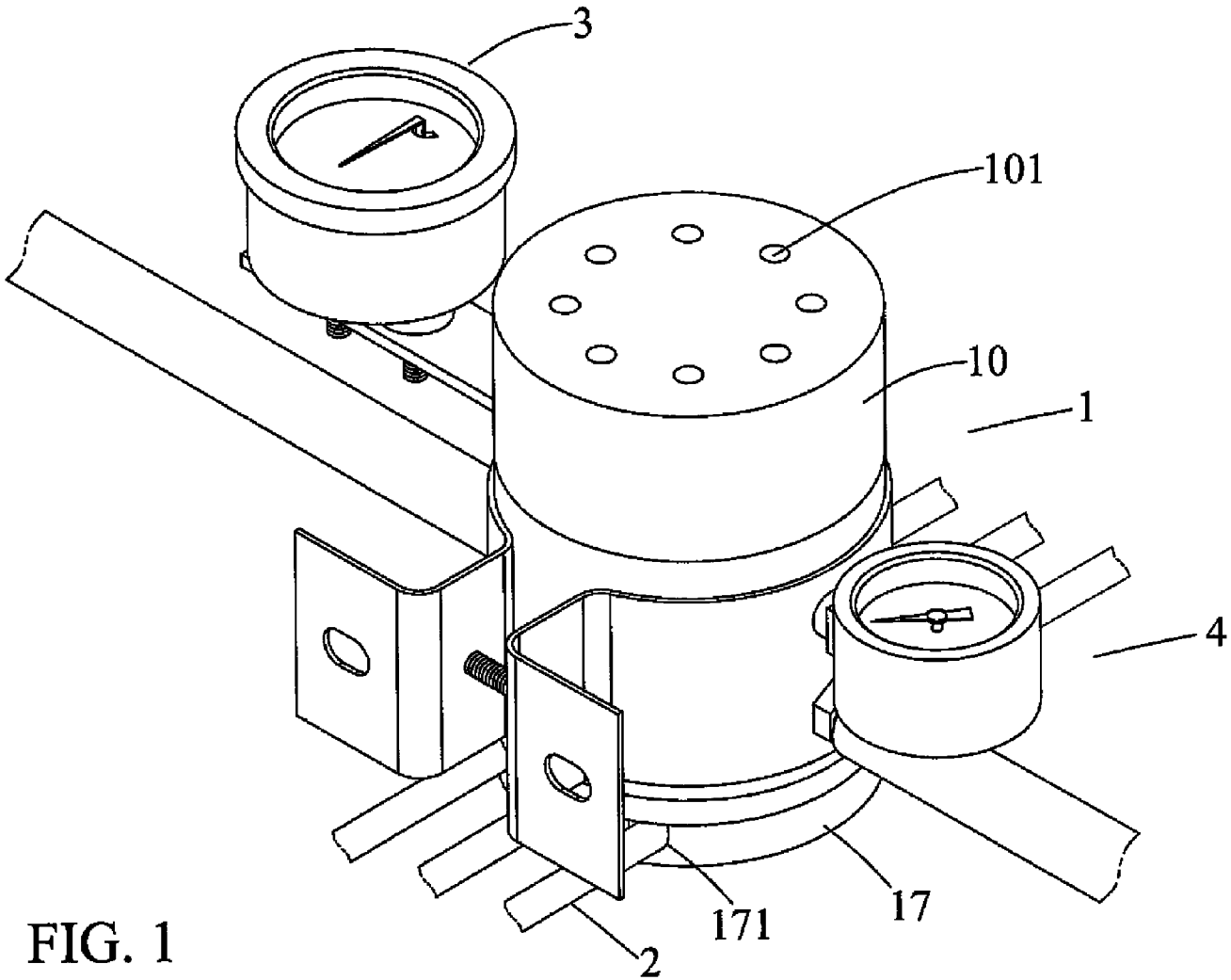
FIG. 1 is an assembly view of a supercharged tube of a vehicle air intake structure in accordance with the present invention.
Figure 2:
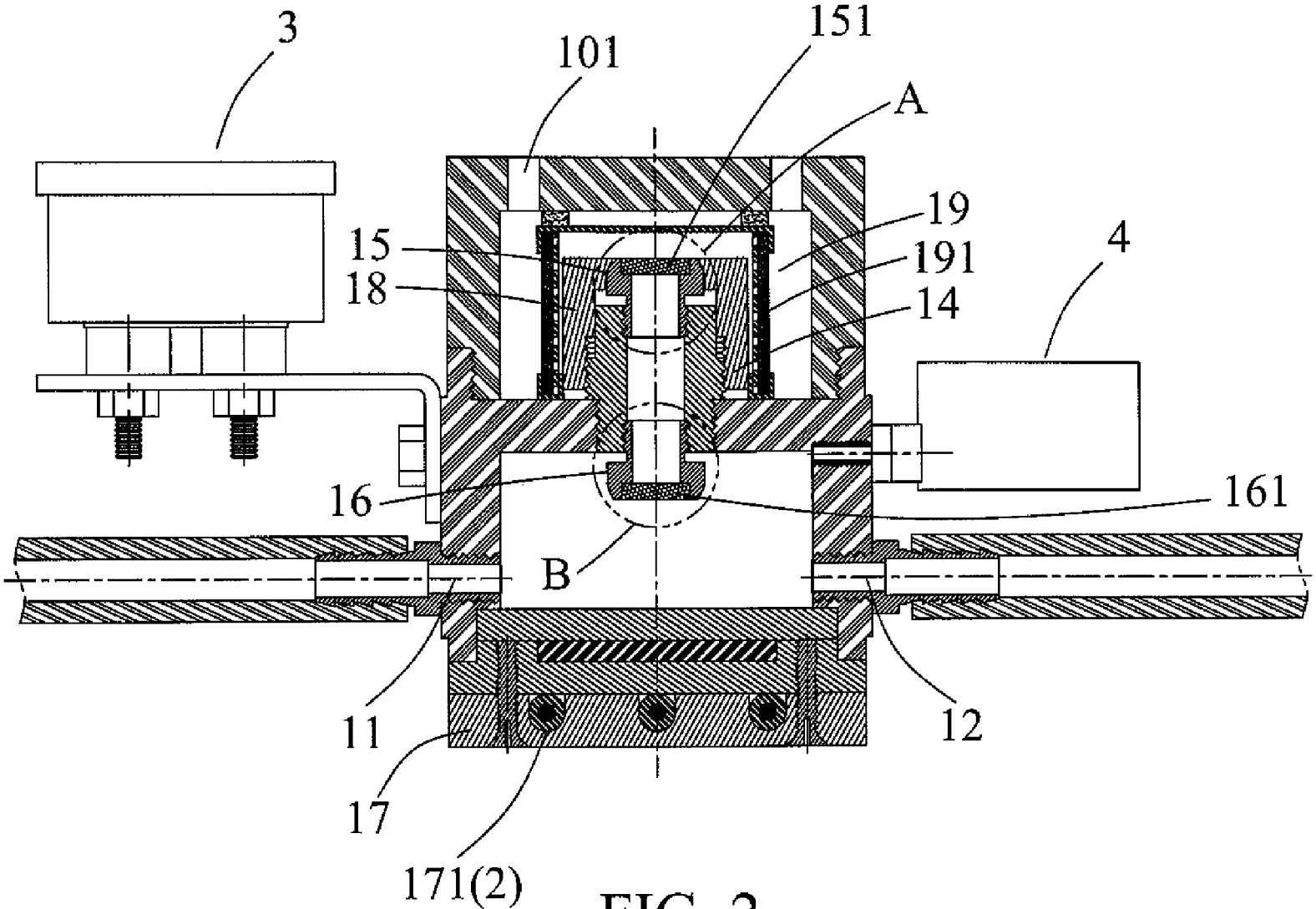
FIG. 2 is a cross sectional view of the supercharged tube of the vehicle air intake structure in accordance with the present invention.
Figure 4:
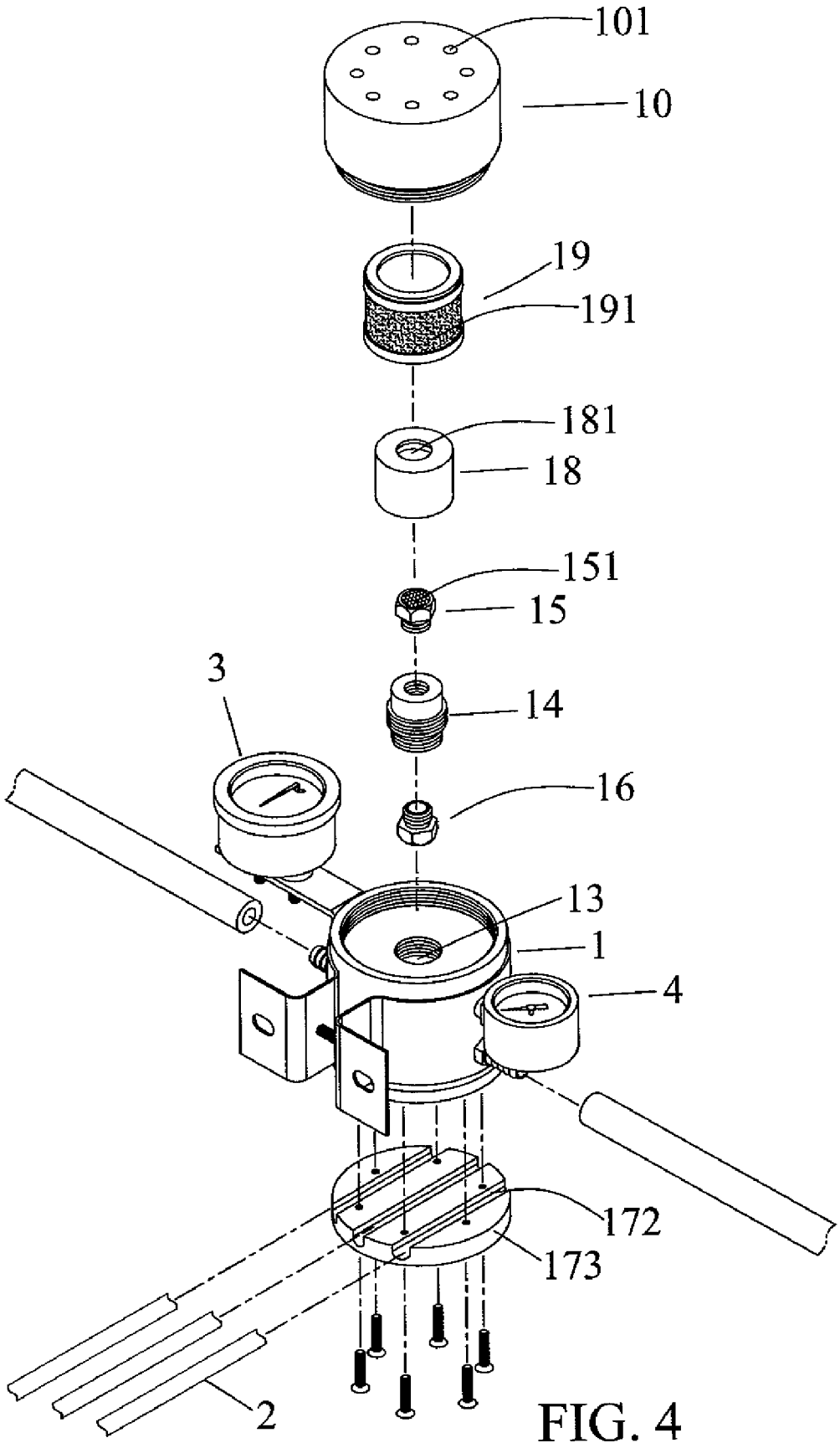
FIG. 4 is an exploded view of the supercharged tube of the vehicle air intake structure in accordance with the present invention.

Referring to FIGS. 1, 2, and 4, a supercharged tube of a vehicle air intake structure in accordance with the present invention comprises a body 1 which can be a good conductor made of aluminum to generate a cooling effect. The body 1 includes a cap 10 having a plurality of through apertures 101, each communicating with a third channel 13. Two side walls of the body 1 are radially provided with a first channel 11 and a second channel 12 respectively. The first and second channels 11 and 12 are in communication with each other. The first channel 11 can be used to communicate with an air pipe system of a brake booster (because it is not a related component of the present invention, it is not shown in the figures), and the second channel 12 serves to be in communication with an intake manifold (because it is not a related component of the present invention, it is not shown in the figures). Before communicating with the intake manifold, the second channel 12 passes through an air collection box or a throttle to communicate with the intake manifold. The body 1 is axially provided with the third channel 13 which communicates with an exterior to provide sufficient air booster so that the intake manifold and a vacuum inlet system of the brake booster boosts pressure and air.

Figure 2A:
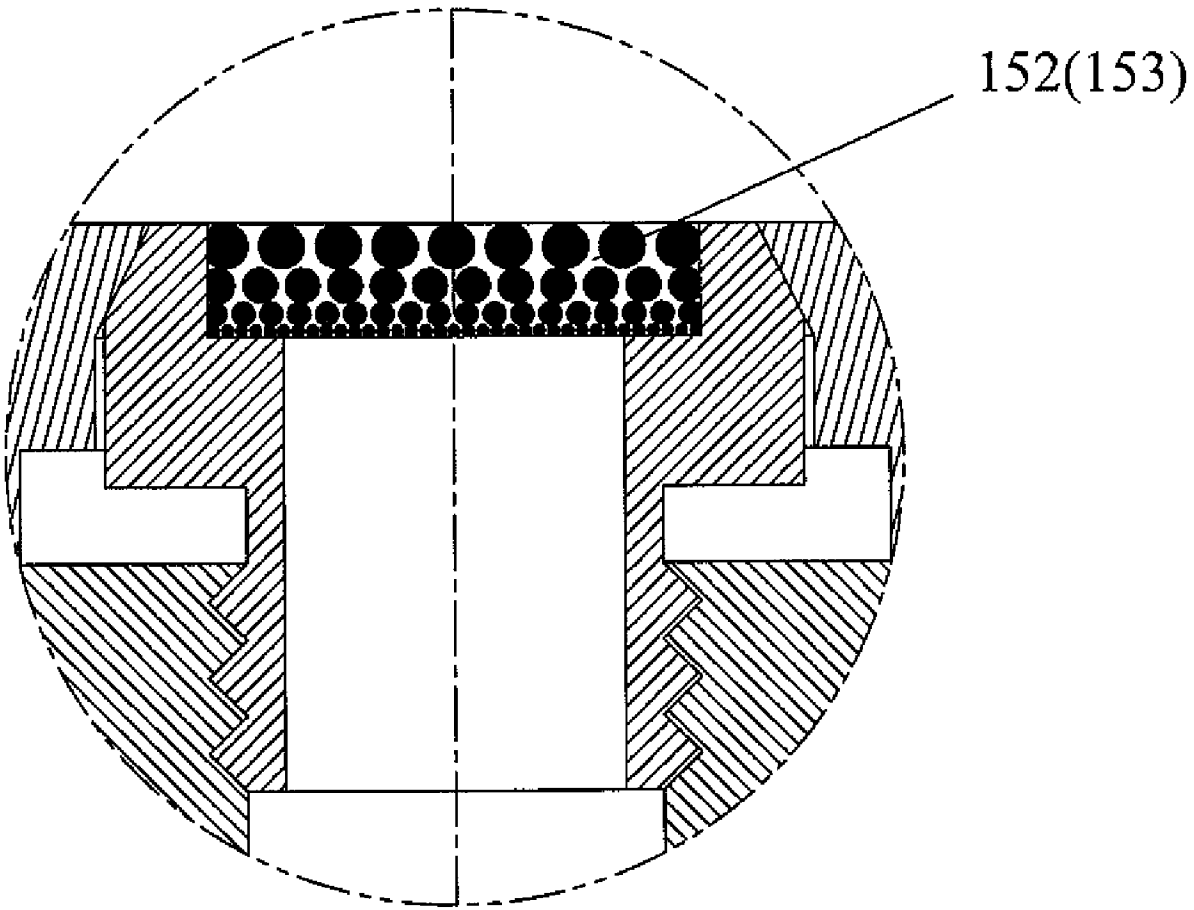
FIG. 2A is a partial amplified view of part A of FIG. 2.
Figure 2B:
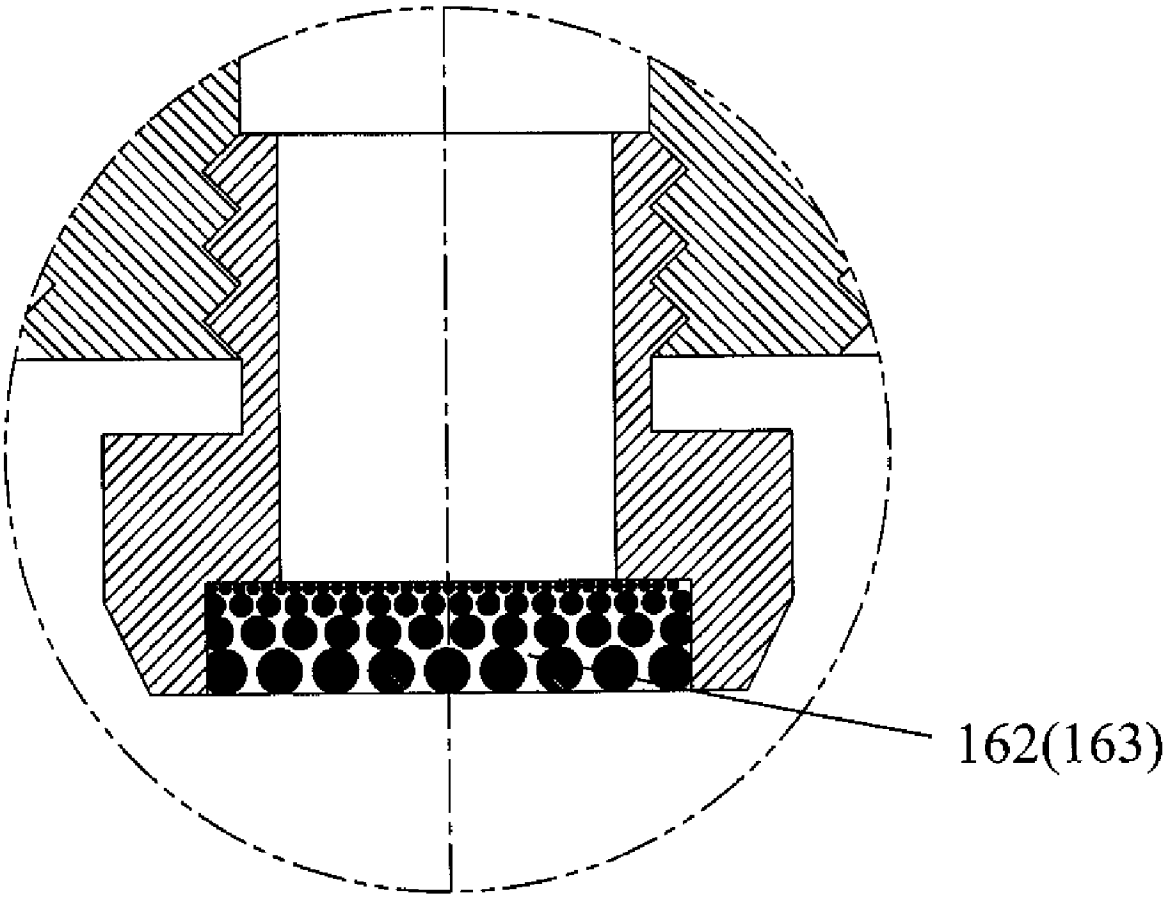
FIG. 2B is a partial amplified view of part B of FIG. 2.

In the third channel 13 is received a tubular member 14 with two ends, one end including a first filter 15 and another end including a second filter 16. The first filter 15 includes a first mesh layer 151 formed on an outer end surface thereof, and the second filter 16 includes a second mesh layer 161 formed on an outer end surface thereof. The first and second mesh layers 151, 161 can be sintered from copper material to tolerance high temperature and are axially mounted with a plurality of first and second passages 152, 162 individually. Inner diameters of the first and second passages 152, 162 are gradually reduced from outside to inside of the first and second mesh layers 151, 161. The first and second passages 152, 162 as shown in FIGS. 2, 2A, and 2B are formed with a plurality of size variable first and second holes 153, 163 from outside to inside of the first and second mesh layers 151, 161. The first and second holes 153, 163 pile together to form a path respectively. If the first and second holes 153, 163 do not pile together, they can form a trumpet-shaped, trapezoid, or irregular path from outside to inside of the first and second mesh layers 151, 161.

Because the booster can boost the exterior air, the first and second filters 15, 16 are provided with the first and second passages 152, 162 arranged on outer end surfaces thereof to form a double check-valve effect so that exterior air and interior remained hot air flow slowly for a period of time. Hence, the exterior air (to support combustion), temperature (an ignition point), and combustible carbon deposit can be mixed and have a slowly-burning time, lowering carbon deposit.

In a preferred embodiment of the present invention, the tubular member 14, the first filters 15, and the second filter 16 are received in a sleeve member 18 including a tunnel 181 axially fixed therein, and the sleeve member 18 is disposed in a hollow filtering cylinder 19 having a filtering material 191 arranged on an outer wall thereof, such that before passing through the first and second filters 15, 16, the exterior air has been filtered by several components to lower its impurities.

Figure 3:
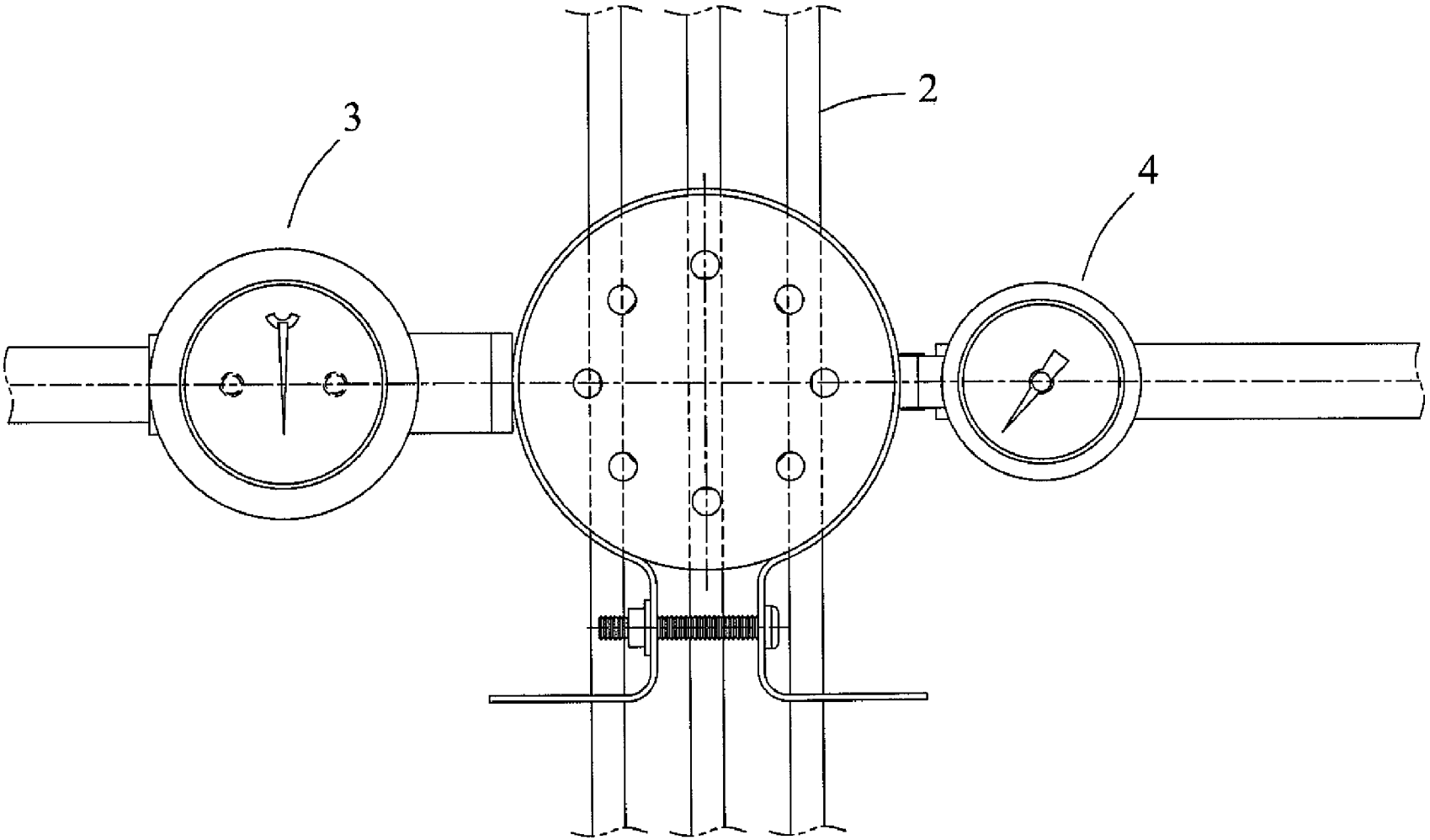
FIG. 3 is a plane view of passageways and a meter.

As shown in FIGS. 1, 2 and 3, a bottom wall 17 of the body 1 is provided with at least one or plural axially crossed passageways 171 to receive one or plural connection lines 2. One side of the body 1 is connected with a meter 3 so that the passageways 171 can connect with the meter 3 through the connection line 2. The meter 3 can be a power display meter or other meters. The connection line 2 can be a high temperature proof line. If the number of the connection line 2 is three, one end of each of two of the three connection lines 2 is connected with a power meter, and one end of the other of the three connection lines 2 is connected with an engine. The other ends of the three connection lines 2 are connected with a battery, a dynamo, and earth individually, such that the meter 3 can display a positive status. Besides, the store space of the connection line 2 can be lowered, and the connection line 2 can be stored as a whole.

As illustrated in FIG. 4, in another preferred embodiment of the present invention, a bottom of the body 1 is defined with a lower cover 173 in response to each other, and the lower cover 173 includes a plurality of recesses 172. As the lower cover 173 is covered onto the body 1, a plurality of passages are formed. On one side of the body 1 is attached an air pressure gauge 4 to display inner pressure of the body 1.

While various embodiments in accordance with the present invention have been shown and described, it is clear to those skilled in the art that further embodiments may be made without departing from the scope of the present invention.

What is claimed is:

1. A supercharged tube of the vehicle air intake structure comprising: a body including a first channel and a second channel radially provided on two side walls thereof respectively, with the first and second channels being in communication with each other, with the first channel used to communicate with an air pipe system of a brake booster, with the second channel serving to be in communication with an intake manifold, with the body being axially provided with a third channel which communicates with an exterior; a tubular member received in the third channel with two ends, with one end of the tubular member including a first filter and another end of the tubular member including a second filter, wherein the first filter includes a first mesh layer formed on an outer end surface thereof, wherein the second filter includes a second mesh layer formed on an outer end surface thereof, with the first and second mesh layers being axially mounted in a plurality of first and second passages individually, with inner diameters of the first and second passages being gradually reduced from outside to inside of the first and second mesh layers, wherein the tubular member, the first filter, and the second filter are received in a sleeve member including a tunnel axially fixed therein, and wherein the sleeve member is disposed in a hollow filtering cylinder having a filtering material arranged on an outer wall thereof.

2. The supercharged tube of the vehicle air intake structure as claimed in claim 1, wherein the first and second passages are formed with a plurality of size variable first and second holes from outside to inside of the first and second mesh layers, wherein the first and second holes pile together to form a path respectively.

3. The supercharged tube of the vehicle air intake structure as claimed in claim 1, wherein a bottom wall of the body is provided with a plurality of axially crossed passageways to receive a plurality of connection lines.

4. The supercharged tube of the vehicle air intake structure as claimed in claim 3, wherein one side of the body is connected with a meter so that the passageways can connect with the meter through the connection line.

5. The supercharged tube of the vehicle air intake structure as claimed in claim 1, wherein the body includes a cap having a plurality of through apertures, each communicating with the third channel.

6. The supercharged tube of the vehicle air intake structure as claimed in claim 1, wherein the first and second mesh layers are sintered from copper material.

7. The supercharged tube of the vehicle air intake structure as claimed in claim 1, wherein one side of the body is attached to an air pressure gauge to display inner pressure of the body.

8. A supercharged tube of the vehicle air intake structure comprising: a body including a first channel and a second channel radially provided on two side walls thereof respectively, with the first and second channels being in communication with each other, with the first channel used to communicate with an air pipe system of a brake booster, with the second channel serving to be in communication with an intake manifold, with the body being axially provided with a third channel which communicates with an exterior; a tubular member received in the third channel with two ends, with one end of the tubular member including a first filter and another end of the tubular member including a second filter, wherein the first filter includes a first mesh layer formed on an outer end surface thereof, wherein the second filter includes a second mesh layer formed on an outer end surface thereof, with the first and second mesh layers being axially mounted in a plurality of first and second passages individually, with inner diameters of the first and second passages being gradually reduced from outside to inside of the first and second mesh layers, wherein a bottom wall of the body is provided with a plurality of axially crossed passageways to receive a plurality of connection lines, wherein a bottom of the body is defined with a lower cover in response to the body, and wherein the lower cover includes a plurality of recesses; and wherein as the lower cover is covered onto the body, a plurality of passages are formed.

9. The supercharged tube of the vehicle air intake structure as claimed in claim 8, wherein one side of the body is attached to an air pressure gauge to display inner pressure of the body.

10. The supercharged tube of the vehicle air intake structure as claimed in claim 8, wherein the first and second passages are formed with a plurality of size variable first and second holes from outside to inside of the first and second mesh layers, wherein the first and second holes pile together to form a path respectively.

11. The supercharged tube of the vehicle air intake structure as claimed in claim 10, wherein one side of the body is connected with a meter so that the passageways can connect with the meter through the connection line.

12. The supercharged tube of the vehicle air intake structure as claimed in claim 8, wherein the body includes a cap having a plurality of through apertures, each communicating with the third channel.

13. The supercharged tube of the vehicle air intake structure as claimed in claim 8, wherein the first and second mesh layers are sintered from copper material.

* * * * *